US010244852B1

(12) United States Patent
Donaldson

(10) Patent No.: US 10,244,852 B1
(45) Date of Patent: Apr. 2, 2019

(54) BEACH EQUIPMENT CARRIER AND LOCATING POLE

(71) Applicant: Raymond E. Donaldson, Falls Church, VA (US)

(72) Inventor: Raymond E. Donaldson, Falls Church, VA (US)

( * ) Notice: Subject to any disclaimer, the term of this patent is extended or adjusted under 35 U.S.C. 154(b) by 0 days.

(21) Appl. No.: 15/672,386

(22) Filed: Aug. 9, 2017

Related U.S. Application Data

(60) Provisional application No. 62/373,592, filed on Aug. 11, 2016.

(51) Int. Cl.
*A45F 4/00* (2006.01)
*A45F 3/10* (2006.01)

(52) U.S. Cl.
CPC ..... *A45F 4/00* (2013.01); *A45F 3/10* (2013.01); *A45F 2004/006* (2013.01)

(58) Field of Classification Search
CPC ..... A45F 4/00; A45F 4/02; A45F 4/04; A45F 4/06; A45F 4/08; A45F 4/10; A45F 4/12; A45F 4/14; A45F 2004/00
USPC ..... 224/577, 575
See application file for complete search history.

(56) References Cited

U.S. PATENT DOCUMENTS 3,658,078 A * 4/1972 Seitel ..... A45B 19/04 135/26
3,797,845 A * 3/1974 Kepka ..... A63C 11/221 280/819
3,833,012 A * 9/1974 McAllister ..... F16B 7/1427 135/114
4,037,726 A * 7/1977 Schweers ..... A47H 1/022 211/105.5
4,049,165 A * 9/1977 Goldhaft ..... A01K 97/00 224/236
4,079,978 A * 3/1978 McMullin ..... F16B 7/105 15/3.51
4,085,474 A * 4/1978 Murphy ..... B08B 9/027 134/167 C
4,263,864 A * 4/1981 Carter, Jr. ..... A01K 77/00 114/221 R
4,509,751 A * 4/1985 Tabet ..... G01P 13/02 294/19.2
4,527,721 A * 7/1985 Goldstein ..... A45B 1/02 135/16
4,576,395 A * 3/1986 Longoria ..... B60R 9/06 224/520
4,659,125 A * 4/1987 Chuan ..... A63B 47/02 16/429

(Continued)

*Primary Examiner* — Brian D Nash
(74) *Attorney, Agent, or Firm* — James Creighton Wray

(57) ABSTRACT

A dual function article carrier is converted into a position marker for use within a crowd after carrying the articles to a desired position. A smaller member slides with an intermediate member that slides with a larger base member. The intermediate member with the smaller member extends from the base member as a carrier. As a position marker the smaller member with a ribbon or pennant on top extends from the intermediate member. Members are slid and held together in a storage condition. Lock pins in holes connect the members. A sleeve is centered in a bucket while it is filled with sand. A lid with a hole is connected to the bucket. The sleeve extends upward. A bottom of the large member is held within the sleeve. Garments and towels are held on arms extended through a member.

16 Claims, 11 Drawing Sheets

(56) References Cited

U.S. PATENT DOCUMENTS 4,733,681 A * 3/1988 Lee ..... A63B 47/02 135/16
4,790,338 A * 12/1988 Strobl ..... A45B 3/00 135/16
4,793,646 A * 12/1988 Michaud, Jr. ..... B63B 21/54 114/221 R
4,887,625 A * 12/1989 Archer ..... A45B 9/00 135/75
5,099,539 A * 3/1992 Forester ..... A47L 1/06 15/144.3
5,188,409 A * 2/1993 Forey ..... A63B 47/02 294/19.2
5,219,105 A * 6/1993 Kravitz ..... B60R 9/06 224/500
5,232,133 A * 8/1993 Speer ..... B60R 9/06 224/485
5,480,170 A * 1/1996 Kaiser, II ..... A47B 31/02 108/80
5,628,540 A * 5/1997 James ..... B60R 9/00 211/189
5,720,465 A * 2/1998 Peltzer ..... A47B 23/007 248/453
5,752,639 A * 5/1998 Rice ..... B60R 9/06 224/510
5,845,664 A * 12/1998 Ryder ..... A45B 3/04 135/65
5,862,967 A * 1/1999 Johnson ..... A45F 3/08 224/153
5,941,435 A * 8/1999 Munro, III ..... A45F 5/14 224/222
6,003,915 A * 12/1999 Bierman ..... E01H 5/02 280/823
6,089,431 A * 7/2000 Heyworth ..... B60D 1/075 224/521
6,192,908 B1 * 2/2001 Smith ..... A45B 5/00 135/65
6,199,570 B1 * 3/2001 Patarra ..... A45B 3/00 135/16
6,217,072 B1 * 4/2001 Gregg ..... A45B 1/04 224/222
6,217,073 B1 * 4/2001 Hoffman ..... A63C 11/221 135/66
6,223,759 B1 * 5/2001 Flippin, Jr. ..... A45B 5/00 135/16
6,471,103 B1 * 10/2002 Frese ..... A01K 97/08 206/249
6,595,226 B2 * 7/2003 Uemura ..... A45B 9/00 135/69
6,602,015 B1 * 8/2003 Evans ..... B60R 9/048 224/924
7,017,931 B1 * 3/2006 Hines ..... B62K 17/00 224/575
7,143,912 B2 * 12/2006 Caneba ..... A45C 13/262 224/153
7,172,219 B2 * 2/2007 Spragg ..... A63C 11/221 280/814
7,718,878 B2 * 5/2010 May ..... F16M 11/34 84/422.1
8,051,864 B1 * 11/2011 Gabrielson ..... A01M 31/025 135/16
8,220,852 B2 * 7/2012 Fenstemaker ..... B25F 1/02 294/51
8,353,434 B2 * 1/2013 Clayton, III ..... A45F 3/10 224/272
8,714,426 B2 * 5/2014 Bohurjak ..... A45F 3/04 224/153
8,931,816 B2 * 1/2015 Sickler, Jr. ..... G01V 3/15 294/190

* cited by examiner

"BEACH BUDDY POLE" EXTENDED CARRY POSITION

"BEACH BUDDY POLE" COLLAPSED

BEACH EQUIPMENT CARRIER AND LOCATING POLE

This application claims the benefit of U.S. Provisional Application No. 62/373,592 filed Aug. 11, 2016, which is hereby incorporated by reference in its entirety as if fully set forth herein.

BACKGROUND OF THE INVENTION

When going to the beach with friends and family many things are needed to be carried, and several trips may be required. When other friends and families later join the fun, it may be difficult for them to find the first group to arrive. Solutions are needed

SUMMARY OF THE INVENTION

This invention solves both problems.

The new invention is a dual purpose product with one main function as a carrier to assist in carrying multiple items including but not limited beach chairs, beach bags, coolers and any other items that can be hung on a pole-like device. The new carrier can be used for any practical application to carry multiple items. The invention size is intended to allow the carrier to fit in most vehicles and or vehicle trunks by using a three piece telescoping system. The first two sections provide the carrier of items. The small one inch section gives the middle section additional strength and rigidity when used as a carrier. Closed cell insulation tubes added to the large and intermediate tubes give some relief from carrying loads on shoulders. Towels placed on shoulders under the tubes provide additional comfort.

The second use of this product is to extend the one inch section for placement of a personally identifiable nylon flag or pennant to clearly identify a location on a beach from a distance. The location identifying aspects could be used for other uses such as tailgating. That would be as an add-on order with separate web address for ordering from a selected vender. In some embodiments the lateral supports at the larger lower end of the extended mast are two pieces of included ¾" PVC pipe. The lateral supports are anchored by standard purpose tent pegs also included in the package. For alternate locations not in the sand at the beach, sand bags (not included) could be placed on the legs for stabilization of the vertical pole. The round head wire lock pins would connect the three sections and also provide anchor points for bungee cords to stabilize the loads and keep them from sliding along the carrier when going up and down inclines or stairs. The hangers attached to the middle PVC pipe would be used to hang wet towels or other items.

Other embodiments use weighted bases with sleeves to hold the base of the extended pole.

These and further and other objects and features of the invention are apparent in the disclosure, which includes the above and ongoing written specification, with the claims and the drawings.

DETAILED DESCRIPTION

Figure 1:
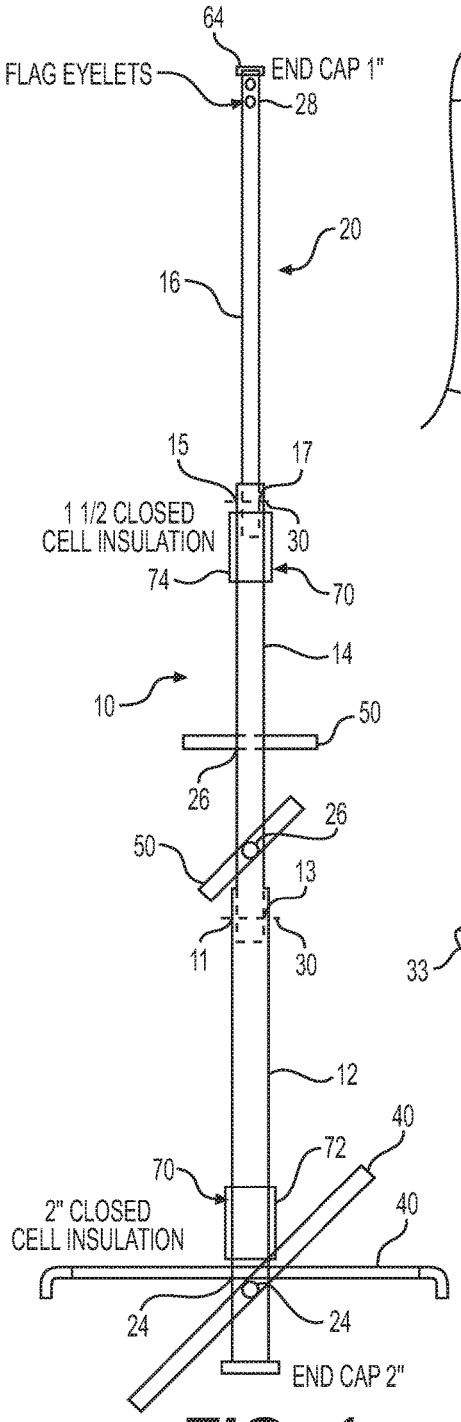
FIG. 1 shows the carrier fully extended as a pole.

FIG. 1 shows the carrier 10 fully extended as a pole 20. As shown in FIG. 1, carrier 10 has three telescoping sections 12, 14 and 16, which are shown extended and locked together as a pole 20 using pins 30. Attachments 40 extend through openings 24 perpendicularly to the pole 20 at its base 22 and perpendicularly to each other to support the pole and to prevent the pole from tipping.

The carrier 10/pole 20 is made of three lengths 12, 14, 16 of tubes, for example PVC tubes that have varied diameters suitable for telescoping. The tubes overlap at ends when extended as a carrier 10 or a pole 20. In the carrier mode, smallest tube 16 is telescoped inside of tube 14 to add strength and rigidity to tube 14. The tubes are held in their fully telescoped for vehicle transportation and storage, with two extended tubes for a carrier or fully extended as a pole. Pins 30 in pin-receiving holes spaced inward from ends of the tubes hold the tubes in those positions.

Pin-receiving holes are formed near the tube ends. When tubes 12, 14 and 16 are telescoped together for storing or transporting in a car, the pin-receiving holes at opposite ends of all of the tubes are aligned. When pins 30 are inserted into the aligned holes, the carrier 10 is ready to be placed in a car or to be stored.

Middle tube 14 has two pin-receiving holes 13, 15 near its opposite ends. Larger tube 12 has a pin-receiving hole 11. Smaller tube 16 has a pin-receiving hole 17 near its inner end.

In the fully extended mode as a position marker pole 20, a pin 30 connects hole 11 in tube 10 with hole 13 in tube 14, and second a pin 30 connects hole 15 in tube 14 with hole 17 in tube 16.

In the carrier mode, a pin 30 connects pin-receiving holes 11, 13 and 17, holding tube 16 within tube 14. Second pin 30 connects pin-receiving hole 15 with a pin-receiving hole or one of the flag eyelets 28 in an outer end of tube 16.

To support pole 20 vertically, mutually perpendicular tubes 40 are inserted in holes 24 near the bottom of tube 12. Support tubes 40 are perpendicular to each other and perpendicular to tube 12. Sand, sandbags or pegs can hold down the tubes 40.

Hanger rods 50 are placed through holes 26 in middle tube 14. The rods 50 are perpendicular to each other and to the pole 10 for hanging clothes and towels on the hanger rods. Flag eyelets 28 near the end of tube 16 are used to attach flags, banners or pennants. End caps 62 on tube 12 and 66 on tube 16 keep out sand, dirt and debris from the tubes and the carrier 10.

When used as a carrier 10, hanger lugs 50 are withdrawn from tube 14. Support legs 40 are withdrawn from tube 12. Pins 30 are withdrawn, and smaller tube 16 is telescoped into middle tube 14. Pins 30 are replaced to anchor both ends of tube 16 in tube 14. Tube 16 strengthens tube 14. The hanger 10 is ready to receive loads such as beach chairs, coolers, umbrellas and toys. The loaded carrier is lifted and placed on a shoulder of each of two persons to carry to the destination. The closed cell shoulder pads 70 avoid painful shoulder bone loading.

Figure 2:
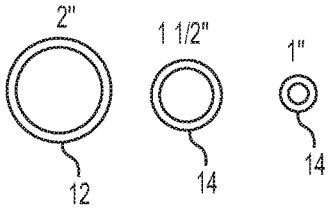
FIG. 2 shows end views of the three tubes which make the carrier.

End views of the telescopic tubes 12, 14 and 16 are shown in FIG. 2.

Figure 3:
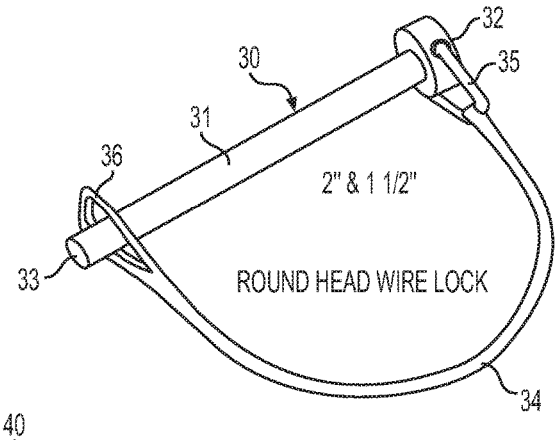
FIG. 3 shows one of the roundhead wire lock pins that connect to the tubes.

FIG. 3 shows one of the round head wire lock pins 30 that hold the tubes in the different positions. The pins 30 have shafts 31 with grooved round heads 32, 33 at opposite ends. A flexible wire 34 has loops 35, 36 at opposite ends. The loops engage the grooves in the heads 32, 33. Loop 35 is permanently attached to the groove in the larger round head 32. Loop 36 is removably attached to the groove in the smaller head 33 that passes with the pin shaft 31 through the pin-receiving holes spaced inward from the ends of the tubes.

Figure 4:
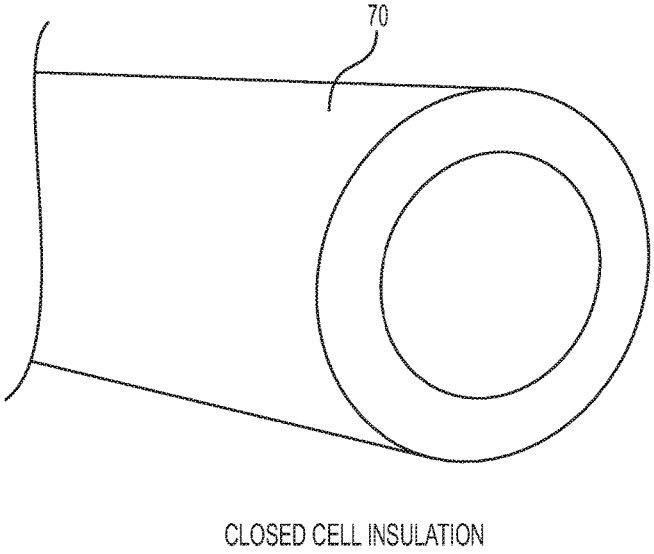
FIG. 4 is a partial perspective view of a shoulder pad.

FIG. 4 is a partial perspective view of one of the shoulder pads 70 shown in FIG. 1. The shoulder pads 72 and 74 are made of pipe insulation pieces with inner diameters to grip outer diameters of tubes 12 and 14. Two shoulder pads 70 made of closed cell pipe insulation are mounted near remote ends of the larger tube 12 and the middle tube 14. Shoulder pad 72 is slightly larger than shoulder pad 74 to accommodate the differences in diameters of the two tubes.

When carrier 10 is collapsed for placing in a car, pins 30 are removed. All of the tubes 2, 14 and 16 are telescoped together and the pins are reinserted in the aligned pin-receiving holes. The pin-receiving holes are aligned by standing the carrier on end cap 62.

Figure 5:
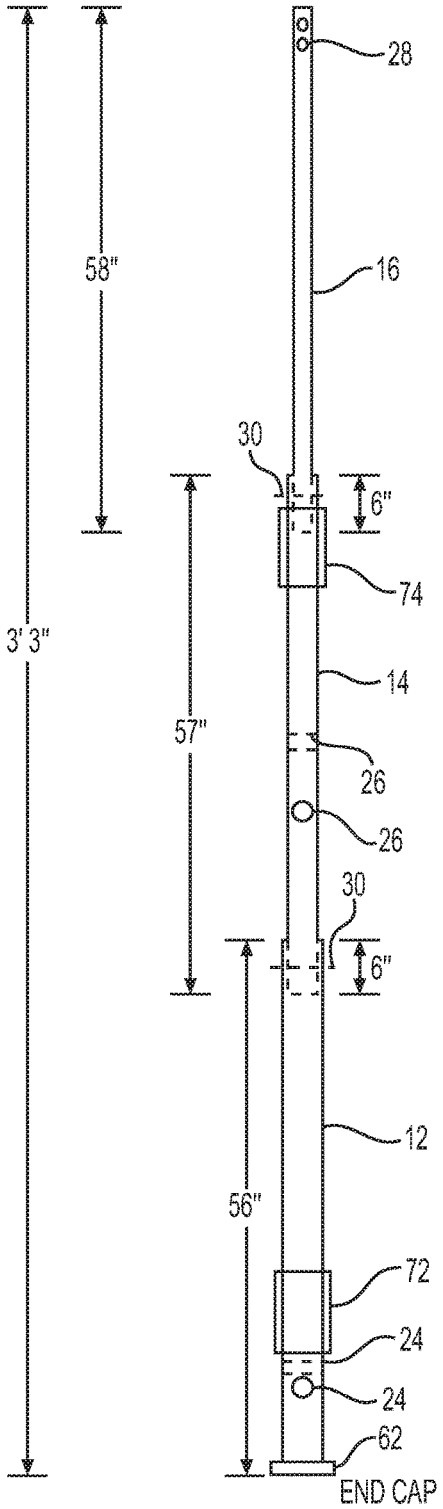
FIG. 5 shows a carrier extended and locked as a pole with relative dimensions of the tubes and overlaps.

FIG. 5 shows a carrier 10 extended and locked as a pole 20 with relative dimensions of the tubes 12, 14, 16 and overlapping portions between adjacent tubes.

Figure 6:
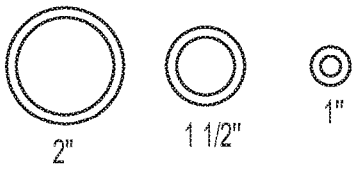
FIG. 6 shows diametrical dimensions of the three tubes.

FIG. 6 shows diametrical dimensions of the tubes 12, 14 and 16.

Figure 7:
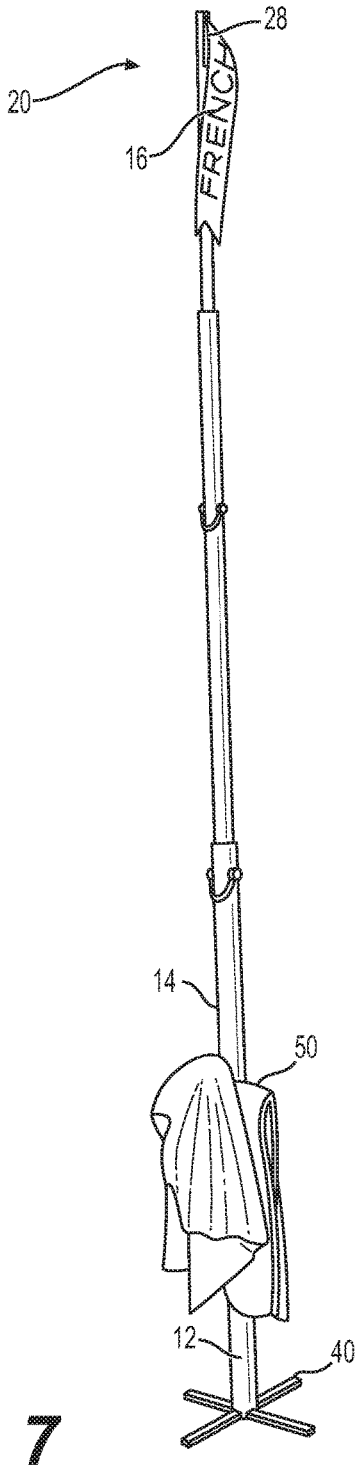
FIG. 7 shows the carrier extended and locked as a pole for a banner or of flag with extensions for hanging clothing and towels and ground support extensions.

FIG. 7 shows the carrier 10 extended and locked as a pole 20 for a flying banner or flag attached to flag eyelets 28 as shown in FIG. 1. Extensions 50 for hanging clothing and towels are shown on middle tube 14. Ground support extensions 40 are shown connected to the largest tube 12.

Figure 8:
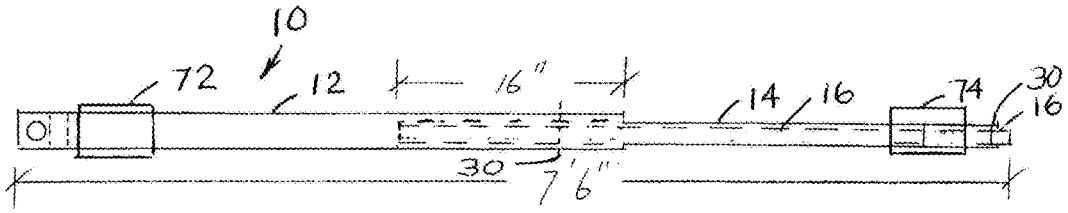
FIG. 8 shows the carrier-pole partially extended to the carrier position.

FIG. 8 shows the carrier-pole partially extended to the carrier 10 position. Inner tube 16 is fully slid into middle tube 14. Middle tube 14 and inner tube 16 are partially slid into outer tube 12. The outer tube 12 overlaps the middle and inner tubes 14 and 16 by about sixteen inches or more, strengthening the carrier. Pins 30 are inserted through holes 15 and 28 at outer ends of tubes 12 and 16 and through aligned holes 39 in each of the three tubes. The pin heads 32 and 33 and wires 34 shown in FIG. 3 provide stops that prevent sliding of carried objects.

Figure 9:
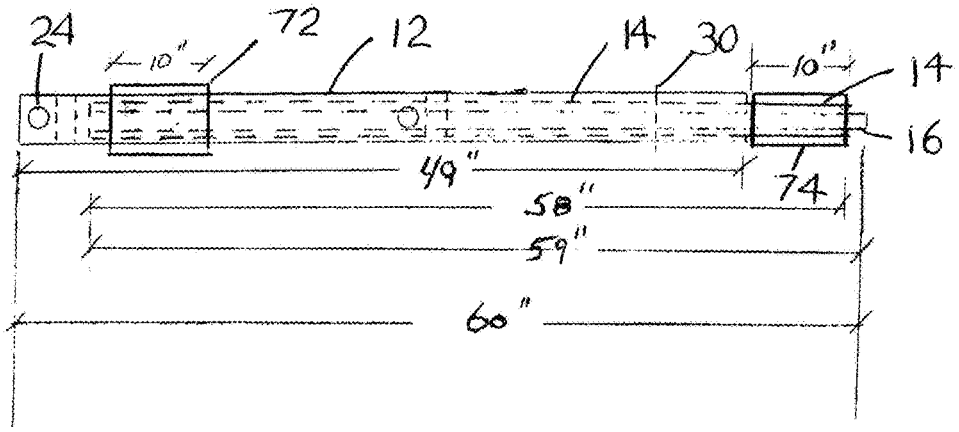
FIG. 9 shows the carrier-pole fully collapsed into stored position.

FIG. 9 shows the carrier-pole fully collapsed into stored position. Pins 30 are inserted through aligned holes in inner ends of the tubes and/or aligned holes near outer ends of the tubes to prevent sliding of the tubes.

Figure 10:
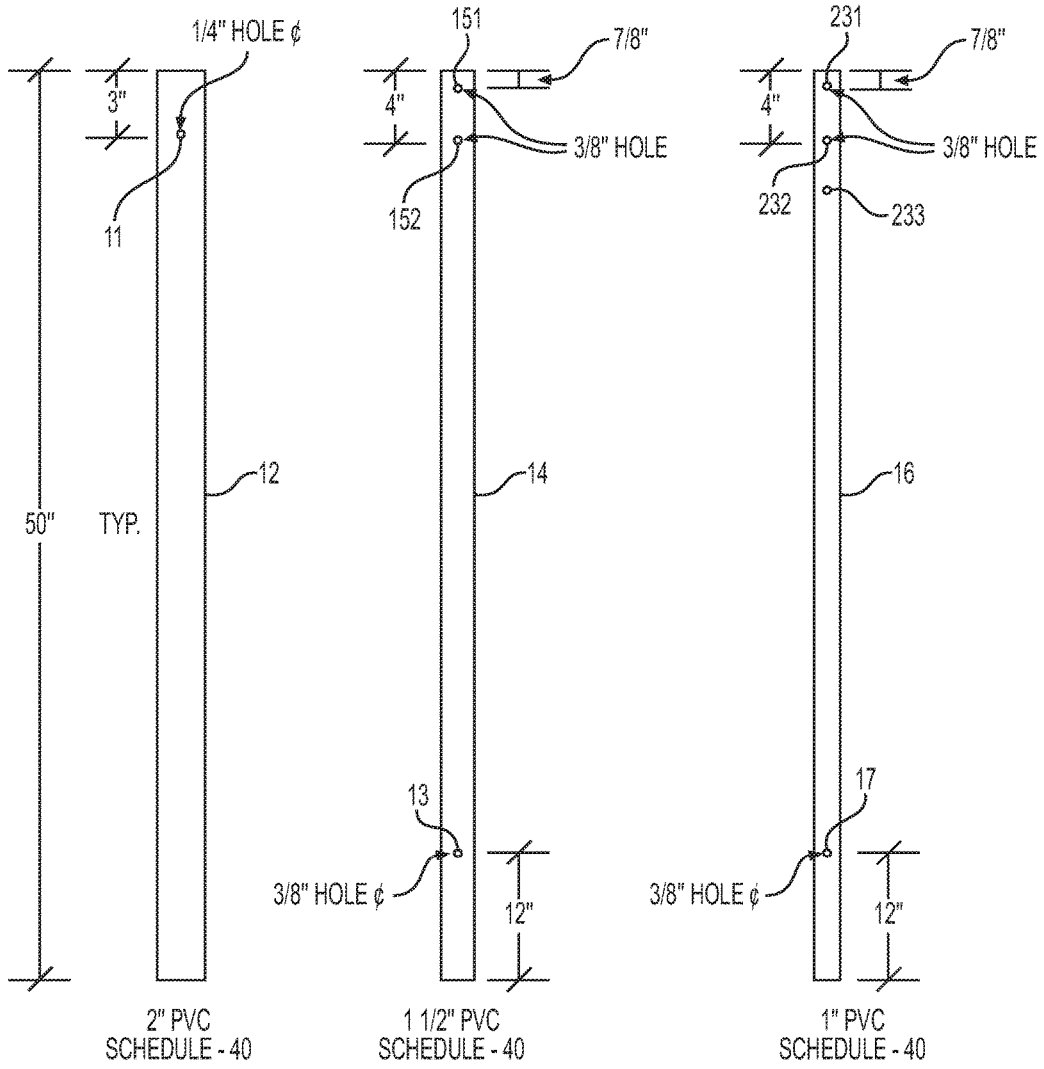
FIG. 10 is a side elevation of the three telescoping poles.
Figure 11:
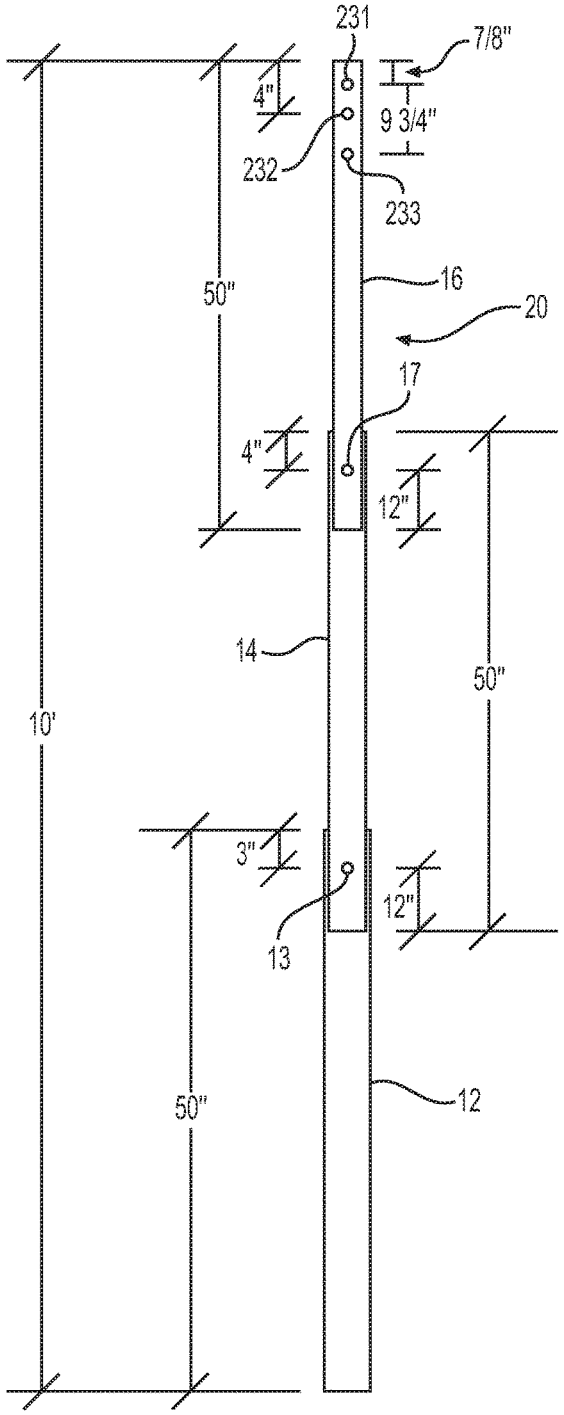
FIG. 11 shows an assembly of the three poles.

FIG. 10 is a side elevation of the three telescoping tubes 12, 14 and 16. FIG. 11 shows an assembly of the three tubes.

All of the tubes in one embodiment are schedule 40 PVC pipes of equal 50 inch length. The base tube 12 is a 2 inch PVC pipe about 50 inches long and has an outer diameter of 2⅜ inches. The middle tube 14 is a 1.5 inch PVC pipe about 50 inches long and has an outer diameter of 1⅞ inches. The inner tube 16 is a 1 inch PVC pipe about 50 inches long and has an outer diameter of 1 5/16 inches.

The base tube 12 has a ¼ inch hole 11 drilled about 3 inches from its upper end. The intermediate pole 14 has a ⅜ inch hole 13 drilled about 12 inches from its lower end and two ⅜ inch holes 151 and 152 drilled about ⅞ inch and 4 inches from the upper end of the intermediate pole 14. The inner tube 16 has a ⅜ inch hole 17 drilled about 12 inches from its lower end and two upper holes 231 and 232 drilled about ⅞ inch and 4 inches from its upper end. A third hole 233 is 9¾ inches from the upper end of tube 16 as shown in the assembled views of the pipes 12, 14 and 16 to form pole 20. Holes 231 and 233 are used to connect the eyelets or grommets of the position-showing flat or pennant.

Figure 12:
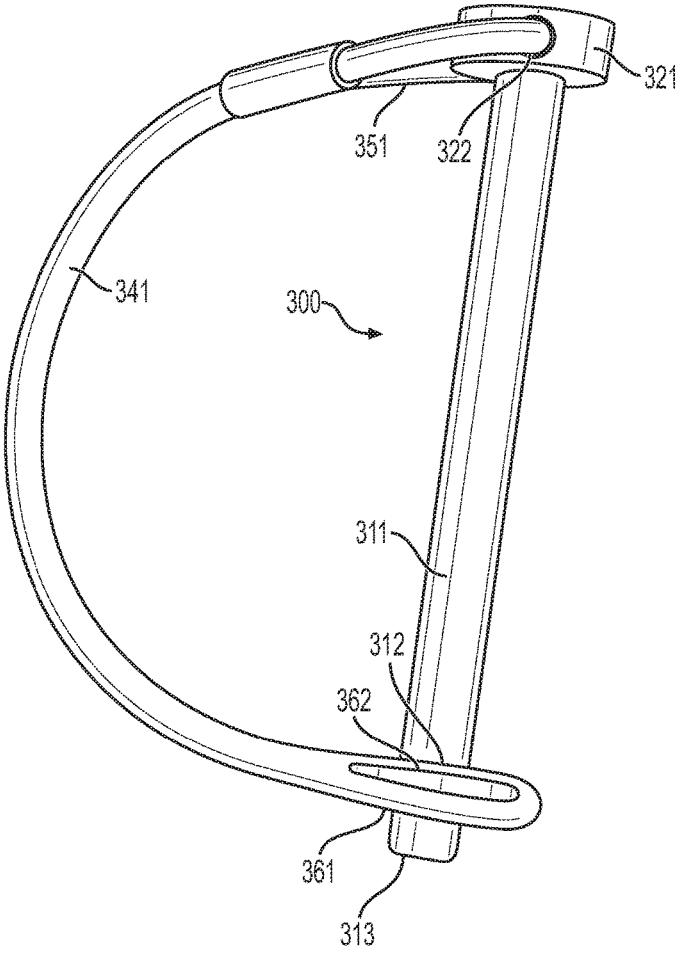
FIG. 12 is a side view of one connecting pin.

FIG. 12 is a side view of one connecting pin. Lock pins 300 in one embodiment have a ¼ inch shaft 311 and an enlarged head 321. A strap 341 has two enlarged ends 351 and 361. End 351 is permanently looped through a hole 322 in the enlarged head 321. End 361 is looped around and permanently fixed to a rubber or polymer grommet 362 that slides along and tightly grips shaft 311 of pin 300. Notches 312 or grooves may be formed near the end 313 of shaft 311 to assist the grommet 362 in gripping the shaft 311.

When the tubes are extended, a lock pin 300 is placed through aligned holes 11 and 13 in the base tube 12 and intermediate tube 14. A second lock pin 300 is placed through aligned holes 152 and 17 in the intermediate and inner tubes 14 and 16. A flag is attached to holes 231 and 233.

Figure 13:
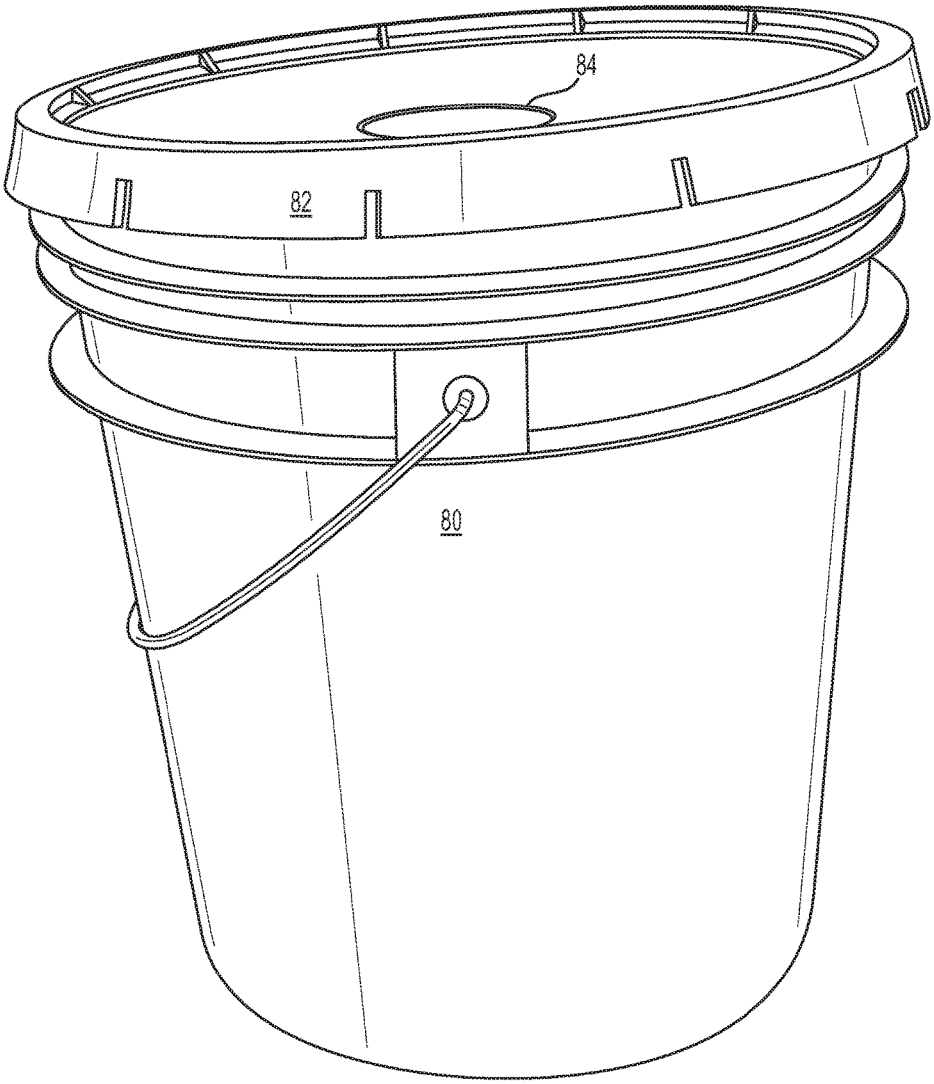
FIG. 13 shows a bucket with a sleeve hole in a lid
Figure 14:
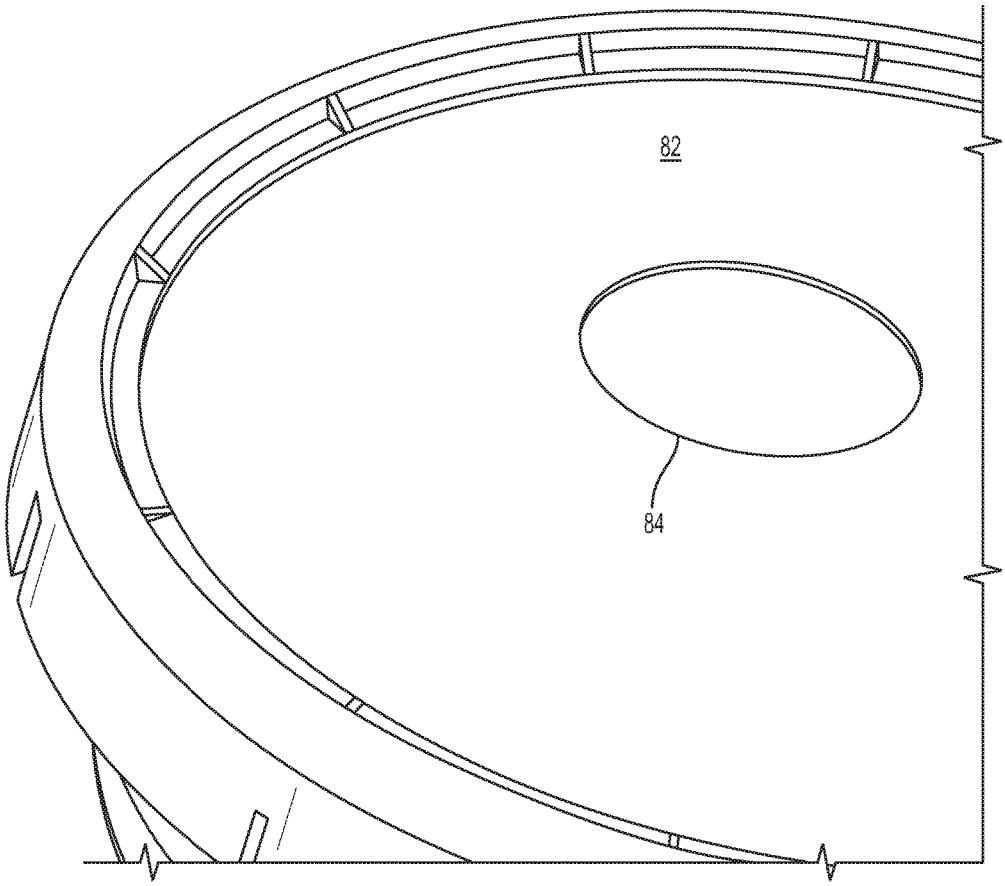
FIG. 14 is a top view of the lid.
Figure 15:
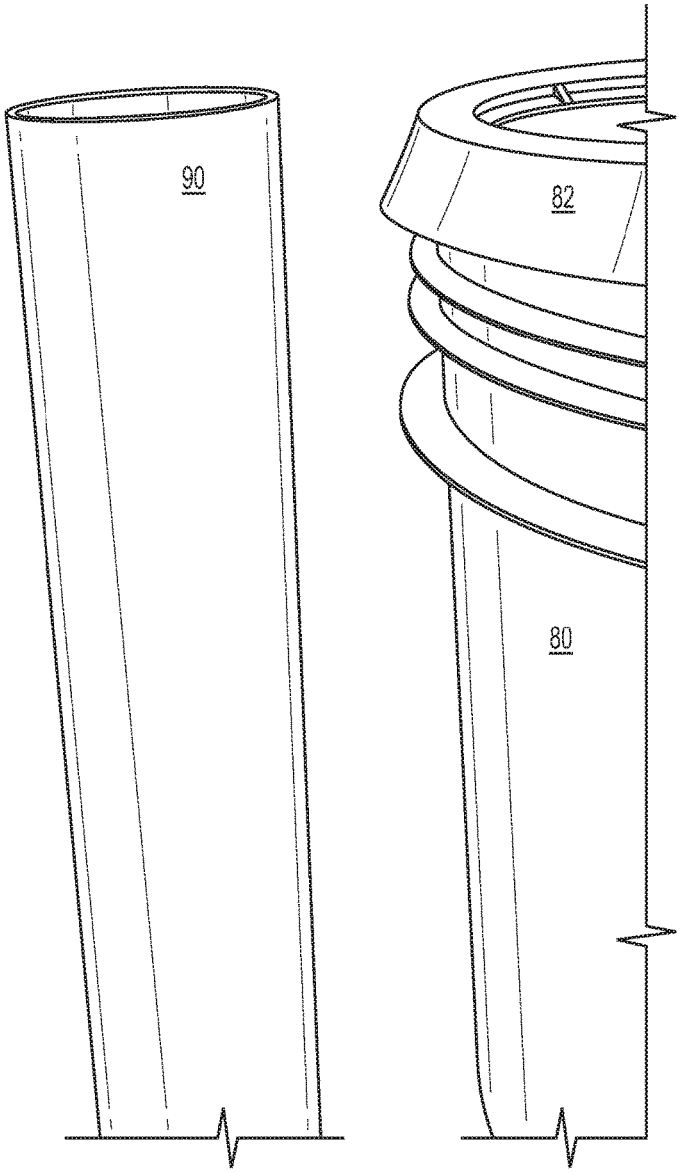
FIG. 15 shows the sleeve that fits within the bucket and lid hole.

FIG. 13 shows a bucket 80 with a sleeve hole 84 in a lid 82. FIG. 14 is a top view of the lid. FIG. 15 shows the sleeve 90 that fits within the bucket 80 and lid hole 84.

Pole-anchoring five gallon bucket 80 has a lid 82. Lid 82 has a central 2⅞ inch sleeve hole 84. The bucket 80 with lid 82 is about 13½ inches tall and about 12 inches in diameter. A 2½ inch PVC sleeve 90 is about 14 inches long. The 2½ inch PVC sleeve 90 has a 2⅞ inch outer diameter that fits tightly in the 2⅞ inch central hole 84 in lid 82.

The sleeve 90 is placed on the bottom and held vertically in the center of bucket 80. Then bucket 80 is filled with sand. The lid 82 is slid on the tube and is placed on the bucket 80. The upper end 92 of the sleeve 90 protrudes about 1 inch from the hole 84 in the lid 82. The lower end of the base pole 12 is inserted in the sleeve.

When the pole 20 is taken down, the base tube 12 is lifted out of the sleeve 90 and the pennant is detached from holes 231 and 233. The two lock pins 300 are withdrawn from aligned holes 11 and 13 and from aligned holes 15 and 17. The inner upper tube 16 is telescoped into the intermediate tube 14. Hole 232 is aligned with hole 15, and the shaft 311 of a lock pin 300 is inserted in the aligned holes 15 and 232. Hole 17 in inner pole 16 thereby automatically is aligned with hole 13 in intermediate pole 14. The two aligned holes 13 and 17 are aligned with hole 11 in the outer base tube 12 and shaft 311 of the second lock pin. The 83 inch long carrier is ready to be used.

The lid 82 is removed from bucket 80 and the sand is dumped from the bucket. The lid 82 is replaced and the bail of the bucket is ready to be hung with the beach chairs on the telescoped poles. Alternatively, the sleeve 90 may be withdrawn from the lid and slid on base pole 12 or slid on the base pole with the lid attached before the second pin is inserted so that the bucket may be filled with toys and collected shells.

Upon reaching the car with the loaded Ox Pole carrier, the load may be removed and the second lock pin 300 may be removed and stored in the aligned holes 151 and 231 so that the intermediate tube 14 may be telescoped into the outer base tube 12 for storage in a car or truck.

The dimensions indicated in the drawings offer ranges of differing sizes and do not limit the invention to particular sizes. The location of holes for attaching the stabilizing supports may vary according to specific uses of the pole 20 on sand or solid ground.

While the invention has been described with reference to specific embodiments, modifications and variations of the invention may be constructed without departing from the scope of the invention, which is defined in the following claims.

I claim:

1. Apparatus comprising:

a two-person carrier assembly configured for carrying beach, picnic or tailgating equipment and being changeable to a position-marking pole, the assembly further comprising:

an outer base tube, an intermediate tube slidable within the outer base tube, an inner top tube slidable within the intermediate tube, first and second fixing connections connect the outer base tube, the intermediate tube and the inner tube, wherein the fixing connections are releasable and fixable in different positions and are adapted for fixing the outer base tube, the intermediate tube and the inner tube in a carrier configuration, with the intermediate tube extended from the outer base tube and the inner tube fixed within the intermediate tube, and wherein the fixing connections are adapted for fixing the outer base tube, the intermediate tube and the inner tube extended in a position-marking pole configuration, wherein the fixing connections further comprise pin-receiving holes in the tubes adapted for aligning with pin-receiving holes in other of the tubes, and lock pins adapted for insertion in the pin-receiving holes, wherein the lock pins are removable from the holes and repositionable.

2. The apparatus of claim 1, the pin-receiving holes further comprising:

a first hole spaced a relatively small distance from one end of the base outer tube, a second hole spaced a relatively larger distance from a first end of the intermediate tube, a third hole spaced a relatively small distance from a second end of the intermediate tube, a fourth hole closer to the second end of the intermediate tube, a fifth hole spaced a relatively larger distance from a first end of the inner tube, a sixth hole spaced a relatively small distance from a second end of the inner tube, and a seventh hole closer to the second end of the inner tube.

3. The apparatus of claim 2, wherein the carrier configuration further comprises a first lock pin connected to the first and second holes and a second lock pin connected to the fourth and sixth holes.

4. The apparatus of claim 2, wherein the position-marking pole configuration further comprises a first lock pin connected to the first and second holes and a second lock pin connected to the third and fifth holes.

5. The apparatus of claim 2, further comprising an eighth hole in the inner tube spaced further from the second end of the inner tube than the sixth hole, and further comprising ribbons, a banner, a flag or a pennant connected to the seventh and eighth holes.

6. The apparatus of claim 2, wherein, when the tubes are fully telescoped for a storage configuration, the first lock pin connects the first, third and sixth holes and a second lock pin is stored connecting the fourth and seventh holes.

7. The apparatus of claim 1, wherein in the carrier assembly is configured for carrying a bungee cord is connected to ends of the outer base tube and the inner tube to hold the items on the carrier.

8. The apparatus of claim 1, further comprising an anchor for the base tube when the outer base tube, the intermediate tube and the inner tube are fixed in the extended position-marking pole configuration, the anchor further comprising a bucket, a lid connectable to a top of the bucket, and a hole in the lid for receiving the base outer tube.

9. Apparatus comprising:

a two-person carrier assembly configured for carrying beach, picnic or tailgating equipment and being changeable to a position-marking pole, the assembly further comprising:

an outer base tube, an intermediate tube slidable within the outer base tube, an inner top tube slidable within the intermediate tube, first and second fixing connections connect the outer base tube, the intermediate tube and the inner tube, wherein the fixing connections are releasable and fixable in different positions and are adapted for fixing the outer base tube, the intermediate tube and the inner tube in a carrier configuration, with the intermediate tube extended from the outer base tube and the inner tube fixed within the intermediate tube, and wherein the fixing connections are adapted for fixing the outer base tube, the intermediate tube and the inner tube extended in a position-marking pole configuration, further comprising an anchor for the base tube when the outer base tube, the intermediate tube and the inner tube are fixed in the extended position-marking pole configuration, the anchor further comprising a tubular sleeve adapted for receiving a bottom of the base tube, a bucket, a lid connectable to a top of the bucket, and a hole in the lid for receiving the tubular sleeve, the tubular sleeve adapted for being centered and held vertically in the bucket, the bucket being adapted for filling with sand around the centered tubular sleeve and the lid being adapted for placing the hole in the lid on the tubular sleeve and pressing down to connect with the top of the bucket, and the base outer tube being adapted to slide into the sleeve, thereby anchoring a bottom of the base outer tube.

10. The apparatus of claim 9, further comprising plural legs connected perpendicularly near one end of the outer base tube and configured for laterally supporting the base outer tube, the intermediate tube and the inner tube when vertically extended.

11. The apparatus of claim 9, further comprising opposite holes extending through the base outer tube at different levels and adapted for receiving the legs extending through the outer base tube near the one end of the outer base tube.

12. The apparatus of claim 9, further comprising hangers extending outward from at least one of the tubes and configured for hanging items on the hangers.

13. The apparatus of claim 12, wherein hanger holes are formed through the intermediate tube and are configured for supporting hangers extending the intermediate tube.

14. A method comprising:

providing a base member, providing an intermediate member configured for sliding and fixing with respect to the base member, providing a smaller member configured for sliding and fixing with respect to the intermediate member, and providing fixing elements for fixing the intermediate member slid outward with respect to the base member, fixing the smaller member compressed with the intermediate member in a carrier configuration, fixing the smaller member extending outward from the intermediate member, and fixing the intermediate member extending outward from the base member in a position-marking configuration, wherein when configuring in the position—marking configuration, the fixing comprises:

providing holes near ends of the base member, the intermediate member and the smaller member, providing first and second locking pins, aligning the holes.

inserting the first locking pin in the aligned holes near a second end of the base member and the holes near a first end of the intermediate member, and inserting the second locking pin in the aligned holes near a second end of the intermediate member and in the aligned holes in the first end of the smaller member.

15. The method of claim 14, wherein when configuring the members in a carrier configuration the fixing comprises providing holes near ends of the base member, the intermediate member and the smaller member, providing first and second locking pins, aligning the holes.

inserting the first locking pin in the holes near a second end of the base member aligned with the holes near a first end of the intermediate member and with the holes near a first end of the smaller member and inserting the first locking pin in the aligned holes, aligning the holes in second ends of the base, intermediate and smaller members, and inserting the second locking pins in the aligned holes in the second ends of the base intermediate and smaller members.

16. The method of claim 14, further comprising:

providing bucket, providing a bucket lid with a central hole, providing a sleeve taller than the bucket, the sleeve fitting within the central hole in the bucket lid, holding the sleeve centered in the bucket and standing on a bottom of the bucket, filling the bucket with weighting materials, placing the lid over the bucket with the sleeve in the central hole, securing the lid on the buck, and inserting a bottom end of the base member in the sleeve.

* * * * *